US006951310B2

(12) United States Patent
Anderson

(10) Patent No.: US 6,951,310 B2
(45) Date of Patent: Oct. 4, 2005

(54) SPRAY HEAD AND AIR ATOMIZING ASSEMBLY

(76) Inventor: Steven R. Anderson, 6720 West Trail, Edina, MN (US) 55439

( * ) Notice: Subject to any disclaimer, the term of this patent is extended or adjusted under 35 U.S.C. 154(b) by 216 days.

(21) Appl. No.: 10/164,738

(22) Filed: Jun. 6, 2002

(65) Prior Publication Data

US 2003/0226910 A1 Dec. 11, 2003

(51) Int. Cl.[7] ..... B05B 7/10

(52) U.S. Cl. ..... 239/406; 239/405; 239/424; 239/432; 239/487; 239/491; 239/600; 239/427

(58) Field of Search ..... 239/104, 427, 239/428, 463–468, 600, 405, 406, 423, 424, 239/487, 491, 432; 222/459, 45.6

(56) References Cited

U.S. PATENT DOCUMENTS

| | | | | |
|---|---|---|---|---|
| 1,399,006 | A * | 12/1921 | Terence | 239/404 |
| 2,603,280 | A * | 7/1952 | Bernhard | 239/402 |
| 4,255,125 | A * | 3/1981 | Auclair et al. | 431/354 |
| 5,388,764 | A * | 2/1995 | Moses | 239/74 |
| 6,131,823 | A * | 10/2000 | Langeman | 239/291 |
| 6,132,396 | A * | 10/2000 | Antanavich et al. | 604/82 |
| 6,578,777 | B2 * | 6/2003 | Bui | 239/406 |
| 6,601,782 | B1 * | 8/2003 | Sandholm et al. | 239/427 |

* cited by examiner

*Primary Examiner*—Steven J. Ganey
(74) *Attorney, Agent, or Firm*—Dorsey & Whitney LLP

(57) ABSTRACT

A spray head and air atomizing assembly for providing atomizing air in an air sprayer or other delivery device in which the atomizing assembly includes converging, spiral atomizing fluid passageways.

20 Claims, 7 Drawing Sheets

SPRAY HEAD AND AIR ATOMIZING ASSEMBLY

BACKGROUND OF THE INVENTION

1. Field of the Invention

The present invention relates generally to a spray head air atomizing assembly and more specifically to an air atomizing assembly to control the flow of atomizing air in a fluid spray or other delivery device such as an air sprayer for spraying paints, adhesives, coatings, and other semi-liquid materials.

2. Description of the Prior Art

Two common types of spray or delivery devices exist for spraying or delivering a fluid to a substrate. One such device is a so-called airless type sprayer or delivery device in which an application fluid is forced through one or more nozzle openings at high pressure. With this type of device, the fluid is atomized or disbursed into tiny droplets as a result of the pressurized fluid passing through the nozzle opening.

A second such device is an air or air atomized spray gun or delivery device in which the application fluid passes through a nozzle orifice, at pressures usually much lower than the pressures employed with airless spraying, in combination with atomizing air flowing through a plurality of air orifices surrounding the nozzle opening. The atomizing air functions to atomize or disperse the application fluid after its exit from the nozzle opening.

Various airflow structures have been used in air spraying devices to supply the atomizing air to the application fluid stream. One of these includes a plurality of generally circular holes surrounding the application fluid nozzle opening and sloped to form a generally conical pattern so that the airstreams converge on the application fluid stream exiting the nozzle opening. Often these atomizing air streams are combined with additional air streams or horns at radially spaced positions which are designed to shape the atomized fluid stream.

Other airflow structures have included a nozzle tip having a plurality of external grooves in combination with a nozzle cap to define a plurality of fluid passages which converge in a spiral pattern toward the application fluid stream.

While many of the air atomizing assemblies of the prior art are generally acceptable when being used to atomize relatively low viscosity materials such as paint which are designed to be broken up and atomized easily, their performance is limited and less than satisfactory when used to atomize high viscosity materials (in excess of about 3,000 centipoises) and materials which have a high surface tension such as epoxies, urethanes, polyureas and other adhesives. These high viscosity and high surface tension materials are difficult to atomize and thus tend to "string" a lot as the application material travels from the spray nozzle to the substrate.

Accordingly, there is a need in the art for an improved air atomizing nozzle assembly, and more particularly a need for an air atomizing nozzle assembly which provides improved atomization of both conventional low viscosity materials such as paints as well as materials which have a relatively high viscosity and/or a high surface tension.

SUMMARY OF THE INVENTION

In contrast to the prior art, the present invention provides an improved spray head and air atomizing assembly which overcomes many of the limitations of the prior art. This atomizing assembly is applicable to conventional low viscosity materials such as paint, but is particularly applicable to atomizing materials which have a relatively high viscosity and a high surface tension.

In general, the air atomizing assembly in accordance with the present invention may be used with a conventional air sprayer with a nozzle opening as is conventional in the art. Such air sprayer may be provided with an application fluid supply tube or conduit for a single component material r with an elongated mixing tube for a two component material. In the preferred embodiment, the air atomizing assembly of the present invention includes an air atomizing tip which has a generally outer conical surface that converges in the direction of the nozzle opening. This conical surface is provided with a plurality of atomizing air flow paths or grooves which spiral along the conical surface as it converges. The air atomizing tip is used in combination with an atomizing assembly cap which includes an inner conical surface that mates with a portion of the exterior conical surface of the tip to form a plurality of air passages defined by the grooves in the exterior conical surface of the atomizer tip. The cross-sectional configuration of these air passages as they exit from the atomizing assembly has a generally flattened configuration in which the circumferential dimension of the passages are preferably at least about twice the depth or radial dimension of such passages. Because of the generally flat shape of the air passages at the exit end of the assembly, the airflow has a shear effect on the exiting application fluid. This shear effect tends to break up and shear portions of the application fluid from adjacent portions and results in significantly improved atomization of the application fluid. This is particularly true for materials having a high viscosity and/or high surface tension.

Accordingly, it is an object of the present invention to provide an improved air atomizing assembly for use with an air sprayer or the like.

Another object of the present invention is to provide a quick change air atomized application device.

Another object of the present invention is to provide an air atomizing assembly which provides improved atomization for high viscosity and/or high surface tension materials.

Another object of the present invention is to provide an air atomizing assembly with an improved atomizing tip and cap combination.

A still further object of the present invention is to provide a spraying device with an improved air atomizing assembly as described above.

These and other objects of the present invention will become apparent with reference to the drawings, the description of the preferred embodiment and the appended claims.

DESCRIPTION OF THE PREFERRED EMBODIMENT

The present invention relates generally to a spray head and an air atomizing assembly incorporated therein. As will be described in greater detail below, the spray head of the present invention may be used with an application fluid mixing assembly which in turn is designed for use with an application fluid spray or delivery device such as an air atomized paint sprayer or an air atomized spray or application device. Such sprayers or other application devices are used to deliver application fluids such as paints, adhesives, sealants, semi-liquids and the like, to a substrate. In describing the present invention, the preferred embodiment will be described with respect to an air atomized paint or other application fluid sprayer.

The present invention has applicability to the application of both single component materials as well as two or multiple component materials. Two or multiple component materials are generally chemically cured and thus are commonly applied through a mixing tube or the like to thoroughly mix the components prior to application. In contrast, thorough mixing is generally not required for single component materials which are commonly cured with moisture, light or other means and thus no mixing tube is required. The preferred embodiment will be described with respect to a two or multiple component material in which a mixing tube or the like is preferred. The invention, however, should not be construed as being limited to a two or multiple component system.

In the description of the present invention, terms such as forward end or rearward end may be used to describe surfaces or ends of particular elements of the invention. Accordingly, as used herein, the forward end of an element shall be considered as the end facing or closest to the nozzle outlet end of the mixer assembly, while the rearward end of an element will be considered as the end or portion of an element which faces or is closest to the pressurized fluid inlet end of the mixer assembly. Also, as used herein, the term frustoconical shall have its normal meaning as a cone-shaped surface adjacent to the base of the cone which is formed by cutting off the top of the cone by a plane parallel to the base.

Figure 1:
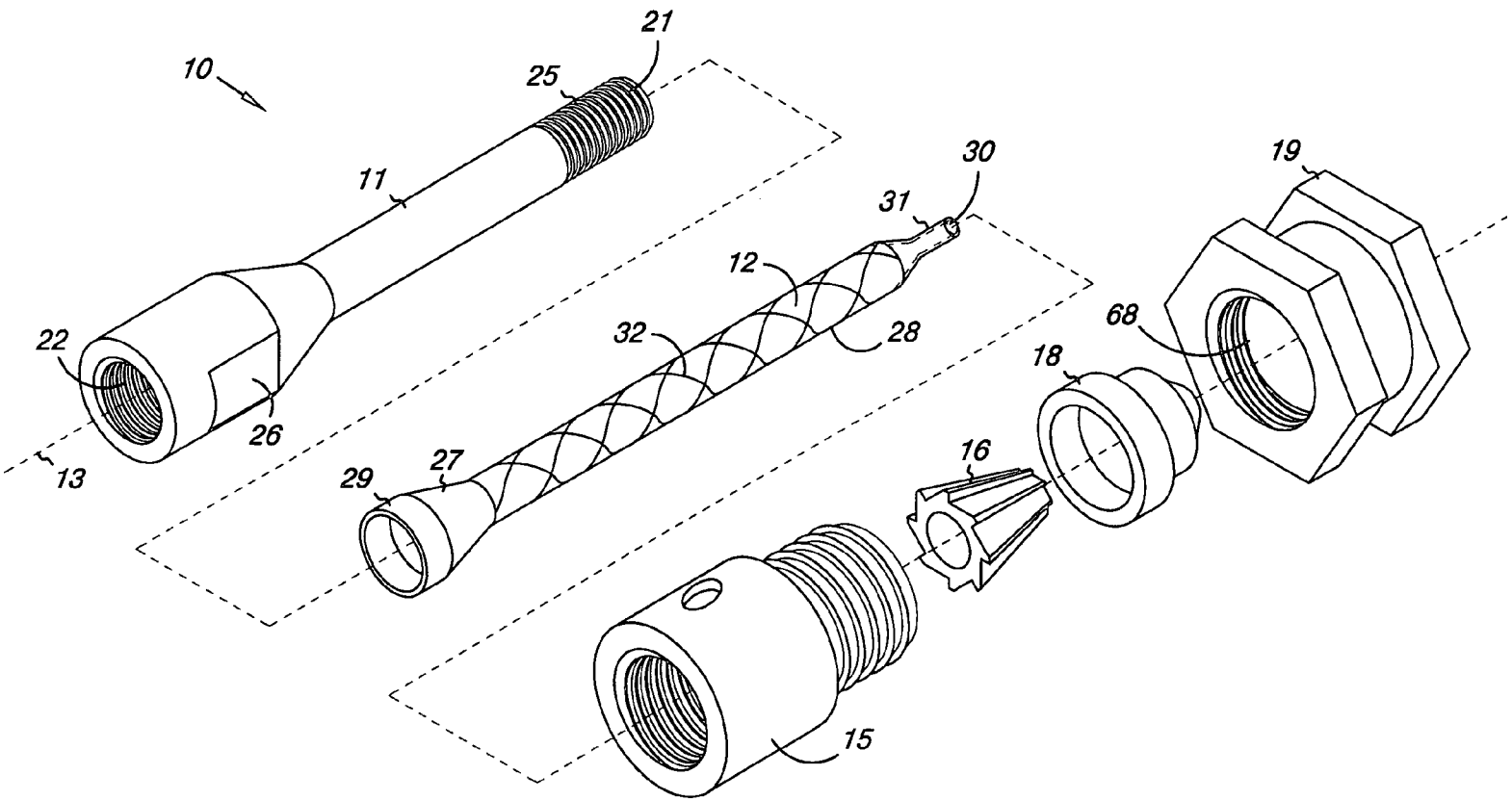
FIG. 1 is an exploded isometric view of a mixer assembly incorporating the spray head and atomizing assembly of the present invention.
Figure 2:
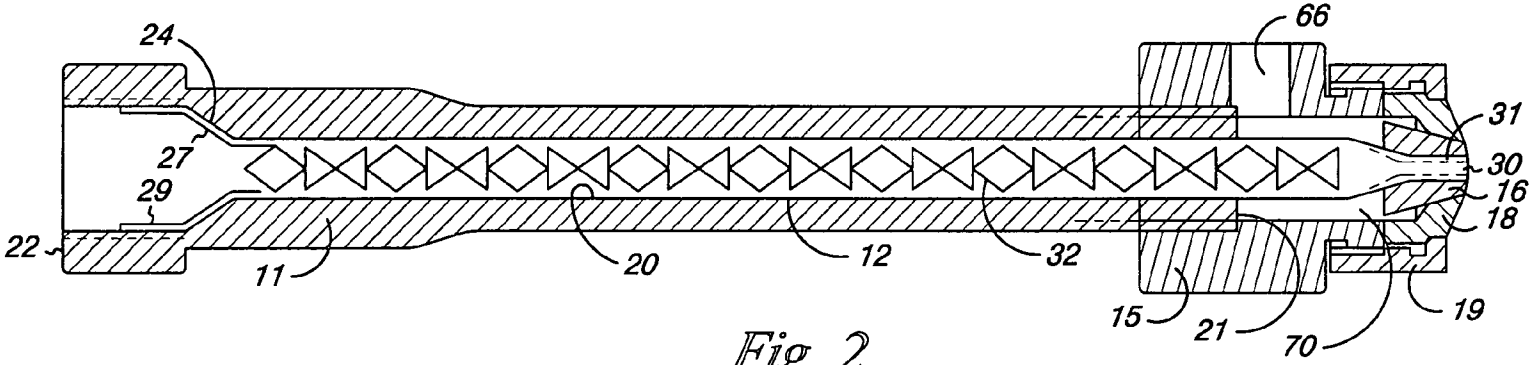
FIG. 2 is a view, partially in section, of the mixer assembly of FIG. 1 as viewed along the longitudinal axis.

With reference first to FIGS. 1 and 2, the spray head of the present invention is part of a mixer assembly 10. The mixer assembly 10 includes an elongated application fluid mixer body 11, an application fluid mixer tube 12 and an air atomizer assembly comprising the air nozzle body 15, the mixer tip 16, the air atomizing cap 18 and the retaining nut 19. The mixer body 11 is an elongated, generally tubular element having a generally cylindrical center opening 20 which extends from the forward end 21 rearwardly to an internally threaded application fluid inlet end 22. As shown best in FIG. 2, a frustoconically shaped surface portion 24 extends between the rearward end of the cylindrical opening 20 and the internally threaded portion 22. The forward end of the body 11 is provided with exterior threads 25. The exterior surface of the mixer body 11 is provided with a pair of flats 26 near the rearward end 22 to rotationally restrain the mixer body 11 during connection of elements to the threaded surfaces 22 and 25 at the rearward and forward ends of the body.

The mixer tube 12 is an elongated tubular member having an exterior cylindrical surface 28 with dimensions approximating those of the inner cylindrical opening 20. The mixer tube 12 also includes a rearwardly positioned annular surface portion 29 and a frustoconically configured exterior surface portion 27. The forward end of the tube 12 includes a narrowed, nozzle end 31 and an application fluid nozzle opening or orifice 30.

The interior of the tube 12 is generally hollow, except for internal baffle means 32 which causes the application fluid to flow in a turbulent circuitous path from its rearward end to the forward end of the nozzle opening 30. The mixer tube 12 is designed to be positioned within the mixer body so that the outer cylindrical surface 28 engages the inner cylindrical surface of the opening 20 and so that the outer frustoconical surface 27 seats against the inner frustoconical surface 24. Mixing tubes of the type illustrated in FIGS. 1 and 2 are well known to those skilled in the art and are commercially available.

Although these elements can be constructed from conventional materials such as stainless steel, brass and other metals, they may also be constructed from various plastics such as nylon, UHMW and polyethylene. This is particularly true for elements such as the tip 16 and the cap 18.

The air atomizer assembly which is comprised of the air nozzle body 15, the mixer or atomizing tip 16, the air atomizing cap 18 and the retaining nut 19 is illustrated in exploded or combined form in FIGS. 1 and 2, with individual components being illustrated in FIGS. 4–10.

Figure 5:
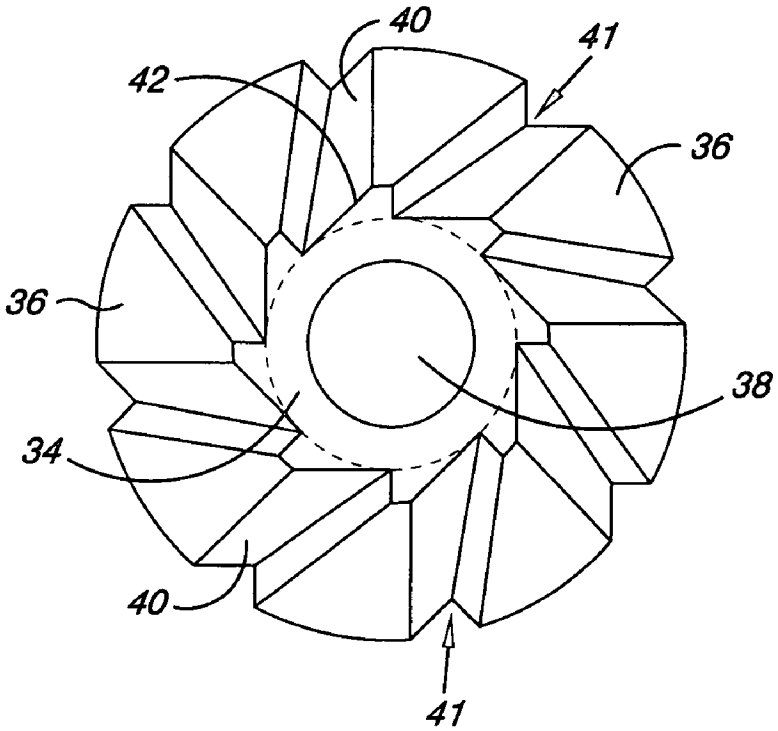
FIG. 5 is an elevational front end view of the mixer tip shown in FIG. 4.
Figure 4:
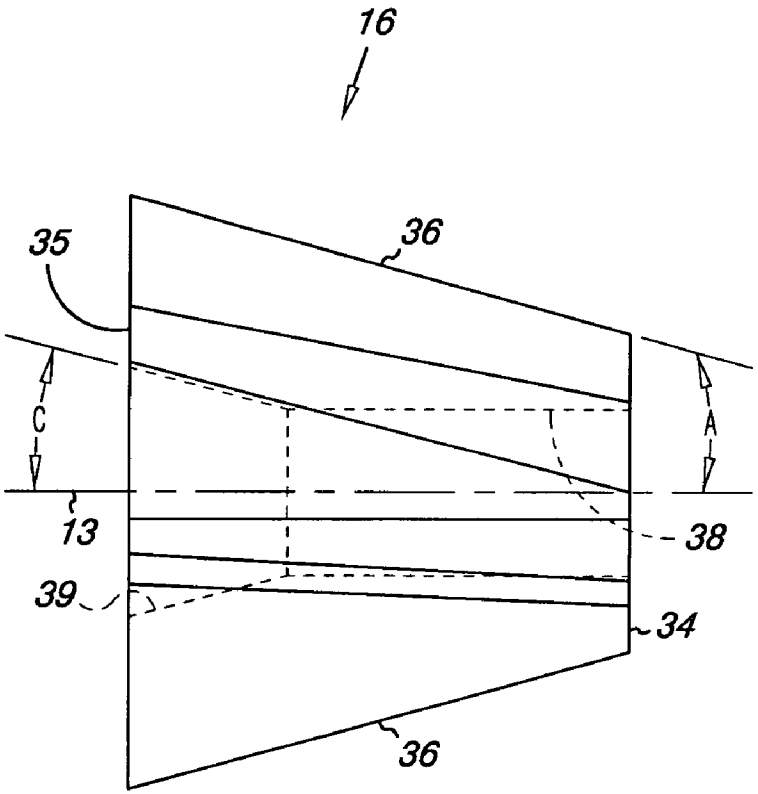
FIG. 4 is an elevational side view of the mixer tip of the air atomizer assembly of the present invention.

With specific reference to FIGS. 4 and 5, the mixer tip or air nozzle tip 16 is shown as a generally conical or frustoconical element having a forward end 34, a rearward end 35 and a generally frustoconical surface portion 36 extending between the forward and rearward ends 34 and 35. As shown, the surface 36 converges as it extends from the rearward end 35 toward the forward end 34. The frustoconical surface includes an axis of revolution 13 which is concentric with the longitudinal axis 13 of the mixer assembly 10. Both the rearward end 35 and the forward end 34 include generally planar annular portions which are oriented at right angles relative to the axis 13. With reference to FIG. 4, the frustoconical angle "A" which the surface portion 36 forms relative to the axis 13 is at least about 5 degrees, more preferably is at least about 10 degrees and most preferably is about 15 to 25 degrees.

The interior of the mixer tip 16 as shown by the broken lines in FIG. 4 includes a generally cylindrical opening 38 which extends rearwardly from the forward end 34 toward the rearward end 35 and a rearwardly positioned frustoconical surface portion 39 which extends from the rearward end of the cylindrical opening 38 to the rearward end 35. The interior surfaces 38 and 39 of the tip 16 are designed to mate with the exterior surface of the nozzle end 31 at the forward end of the mixer tube 12. Preferably, these dimensions are such as to provide a relatively tight interference fit between the surfaces of elements 31 and 38. In the preferred embodiment, the angle "C" which the frustoconical surface forms with the axis 13 matches the angle "A".

With continuing reference to FIGS. 4 and 5, the exterior frustoconical surface portion 36 is provided with a plurality of grooves or flow channels 40 which extend from the rearward end 35 to the forward end 34. As shown, these grooves or channels 40 extend from the rearward end 35 toward the forward end 34 in a generally spiral or helical pattern. The spiral angle, or the angle which each of the grooves 40 forms with a plane extending through the axis 13, is less than 30 degrees, more preferably between about 5 degrees and 25 degrees and most preferably between about 10 degrees and 20 degrees. As shown best in FIG. 5, these grooves 40 extend from the rearward end 35 to the forward end 34 and form a recess 41 in the rearward end 35 and a recess 42 in the forward end 34. The recess 42 in the forward end which is the most critical end with respect to the present invention is shown in the enlarged view of FIG. 6. As shown, the recess 42, and thus the groove 40, includes a radial dimension "rd" and a circumferential distance "cd". The radial dimension "rd" is measured in the radial direction relative to the axis 13, while the circumferential dimension "cd" is measured in the circumferential direction relative to the axis 13.

Figure 6:
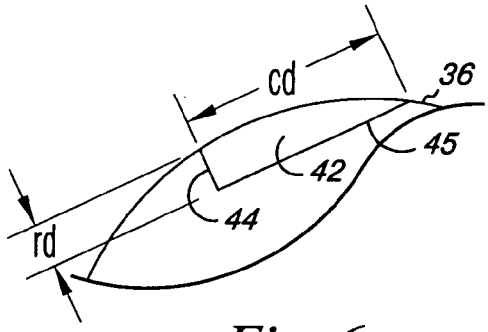
FIG. 6 is an enlarged view of one of the airflow grooves in the mixer tip.

A feature of the preferred embodiment of the present invention is that the cross-sectional configuration of the recess 42 or the groove 40 as measured at the forward end 34 has a generally flat configuration in which the circumferential dimension "cd" is greater than the radial dimension "rd". More preferably, the circumferential dimension "cd" is at least twice the radial dimension "rd" and most preferably the circumferential dimension "cd" is at least three times the radial dimension "rd". In the embodiment shown in FIGS. 4–6, the cross-sectional configuration of the recess 42 formed by the groove 40 is a generally two-sided configuration having a radial edge portion 44 and a circumferential edge portion 45. As shown in FIG. 6, the ends of the portions 44 and 45 intersect with one another and also with the frustoconical surface 36.

Figure 11:
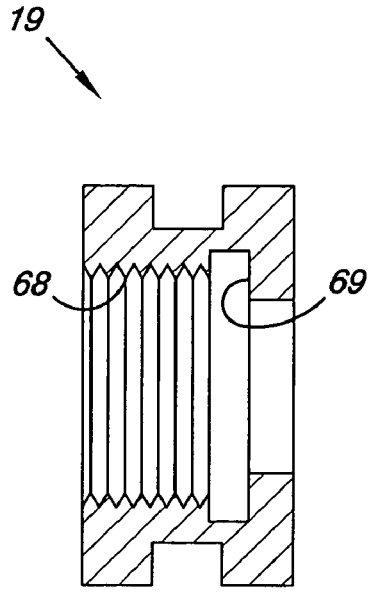
FIG. 11 is a view, partially in section, of the air atomizing cap retaining nut.
Figure 12:
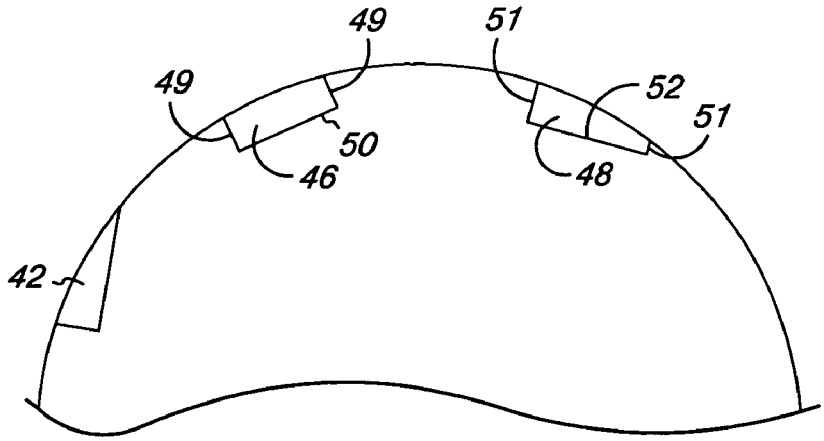
FIG. 12 is a view showing a variety of cross-sectional configurations of the spiral airflow grooves in the mixer tip of the present invention.

In addition to the cross-sectional configuration of the recess 42 shown in FIG. 6, such configuration can take a number of other forms as shown in FIG. 11. Specifically, the recess 42 is shown along with two other possible configurations 46 and 48. The recess 46 is shown as having two generally equal radial edges 49,49 in combination with a circumferential edge 50, while the recess 48 is shown as having two radial edges 51,51 of unequal length in combination with a circumferential edge 52. In all of these configurations, it is preferable for the recesses 42,46 and 48 to have a generally flat configuration with the circumferential dimensions being greater than the radial dimensions, more preferably at least about twice the radial dimensions, and most preferably at least about three times the radial dimensions.

Figure 7:
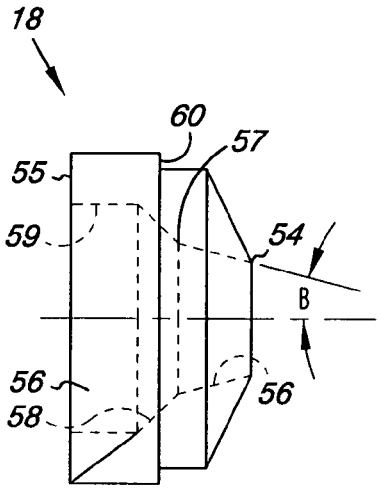
FIG. 7 is an elevational side view of the air atomizing cap of the air atomizer assembly of the present invention.
Figure 8:
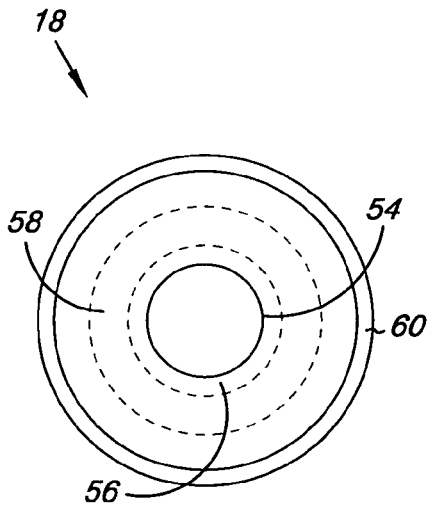
FIG. 8 is an elevational front end view of the air atomizing cap of FIG. 7.

The air atomizing cap 18 is shown best in FIGS. 7 and 8. The cap has a forward end or edge 54, a rearward end 55 and an interior surface extending from the forward end 54 to the rearward end 55. This interior surface includes a first frustoconical surface portion 56, a second frustoconical surface portion 58 and a rearward, generally cylindrical surface portion 59. As shown, the first frustoconical surface portion 56 extends from the forward end 54 rearwardly to a point 57 where it joins with the forward end of the second frustoconical surface portion 59. The surface portion 59 extends forwardly from the rearward end 55 and joins with the surface portion 58.

As shown best in FIG. 7, the angle "B" which the frustoconical surface portion 56 forms with the axis 13 is less than that of the frustoconical surface 58. Preferably, the surface portion 56 has a frustoconical angle "B" matching that of the exterior frustoconical surface 36 of the mixer tip 16. Accordingly, it is preferably at least about five degrees, more preferably at least about ten degrees and most preferably about 15 to 25 degrees.

Figure 3:
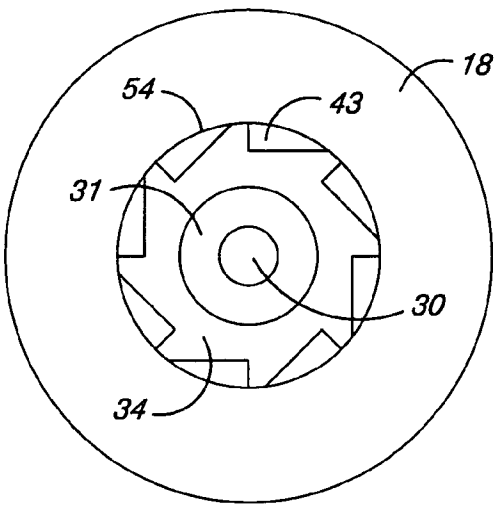
FIG. 3 is an enlarged elevational end view of the forward or nozzle end of the mixer assembly.

When the air atomizing cap 18 is assembled in operational position with the mixer tip 16 as shown in FIGS. 2 and 3, the interior frustoconical surface portion 56 engages and mates with a portion of the exterior frustoconical surface 36 to form a plurality of passageways 43 (FIG. 3) defined by the grooves 40. Preferably the length of the passageways 43 is no less than about 3/16 of an inch and preferably no less than the diametrical dimension of the surface portion 56 at the forward end 54. Most preferably, the axial length of the surface portion 56 from the forward end 54 to the point 57, relative to the cross-sectional configuration and size of the passageways 43 should be sufficient to create laminar flow within such passageways 43.

Because the angle which the frustoconical surface portion 58 forms with the axis 13 is significantly larger than the angle "B", the surface portion 58 and surface 59 are spaced outwardly from the corresponding area of the surface portion 36 of the tip 16 (FIG. 4), thereby creating a flow area to provide atomizing fluid to the passageways 43.

The rearward end 55 of the atomizing cap 18 is generally annular and is perpendicular to the axis 13. When the device of the present invention is assembled, the surface 55 seats against the forward end of the air nozzle body 15 as described below. The exterior surface of the atomizing cap 18 is provided with a retaining shoulder 60 which mates with corresponding structure of the retaining nut 19 to retain the atomizing cap 18 in an assembled position relative to the air nozzle body 15 and thus the mixture body 11.

Figure 9:
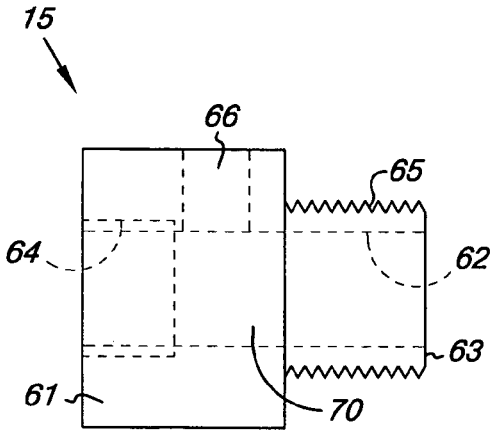
FIG. 9 is an elevational side view of the air nozzle body.
Figure 10:
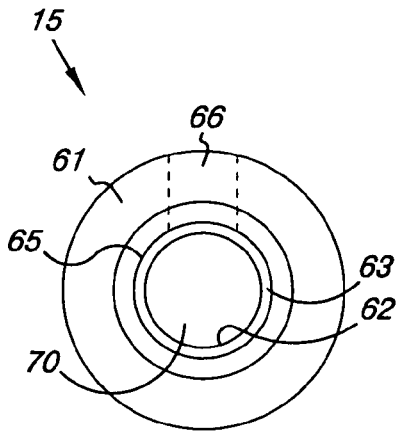
FIG. 10 is an elevational front end view of the air nozzle body shown in FIG. 9.

The air nozzle body 15 which is shown generally in FIG. 1 and in greater detail in FIGS. 9 and 10 includes a generally cylindrical main body portion 61 having an inner surface 62 defining a generally hollow interior chamber 70. The rearward end of the main body 61 is provided with a plurality of interior threads 64 to connect with the threads 25 at the forward end of the body 11. A nipple 63 with external threads 65 extends forwardly from the main body 61 for connection with the retaining nut 19. An atomizing fluid inlet port 66 is provided in the side of the main body portion 61. The port 66 communicates with the interior chamber 70 and is provided with interior threads for connection to a source of pressurized atomizing air (not shown). For application of a single component material, the mixer tube can be replaced by material supply tube.

The retaining nut 19 (FIG. 11) includes a plurality of interior threads 68 at its rearward end and a retaining shoulder 69 near its forward end. When assembled, the interior threads 68 are received by the exterior threads 65 of the nipple portion 63 and the shoulder 69 engages the retaining shoulder 60 of the atomizing cap 18. Accordingly, the retaining nut retains the cap 18 and thus the tip 16 to the nozzle body 15 and thus the mixer body 11.

When assembled in this manner as shown best in FIG. 2, an atomizing fluid chamber 70 is provided within the nozzle body 15 to provide atomizing fluid to the spiral passageways 43 (FIG. 3) formed by the grooves of 40 in combination with the inner frustoconical surface 56 of the cap 18. When pressurized atomizing air is provided to the chamber 70, this air exits the passageways 43 at the forward end 34 of the tip 16 in generally flat, converging and spiraling streams.

As application fluid is discharged through the nozzle tip 30 from a pressurized source, the flat, converging and spiraling streams of atomizing fluid contact the discharged application fluid stream and dispenses or atomizes the stream into tiny droplets. Although applicant does not wish to be bound by any particular theory, it is believed that because of the generally flat shape or configuration of the atomizing air flow streams as they exit the atomizing nozzle assembly, the application fluid stream is subjected to shear forces and thus provides more thorough and complete atomization, particularly for fluids which are highly viscous and/or exhibit a high tensile strength. Preferably, the circumferential dimension "cd" of the recesses 42 (and thus passageways 43) at the forward end of the tip 16 is greater than the radial dimension "rd", more preferably twice as great and most preferably about three times as great.

Figure 13:
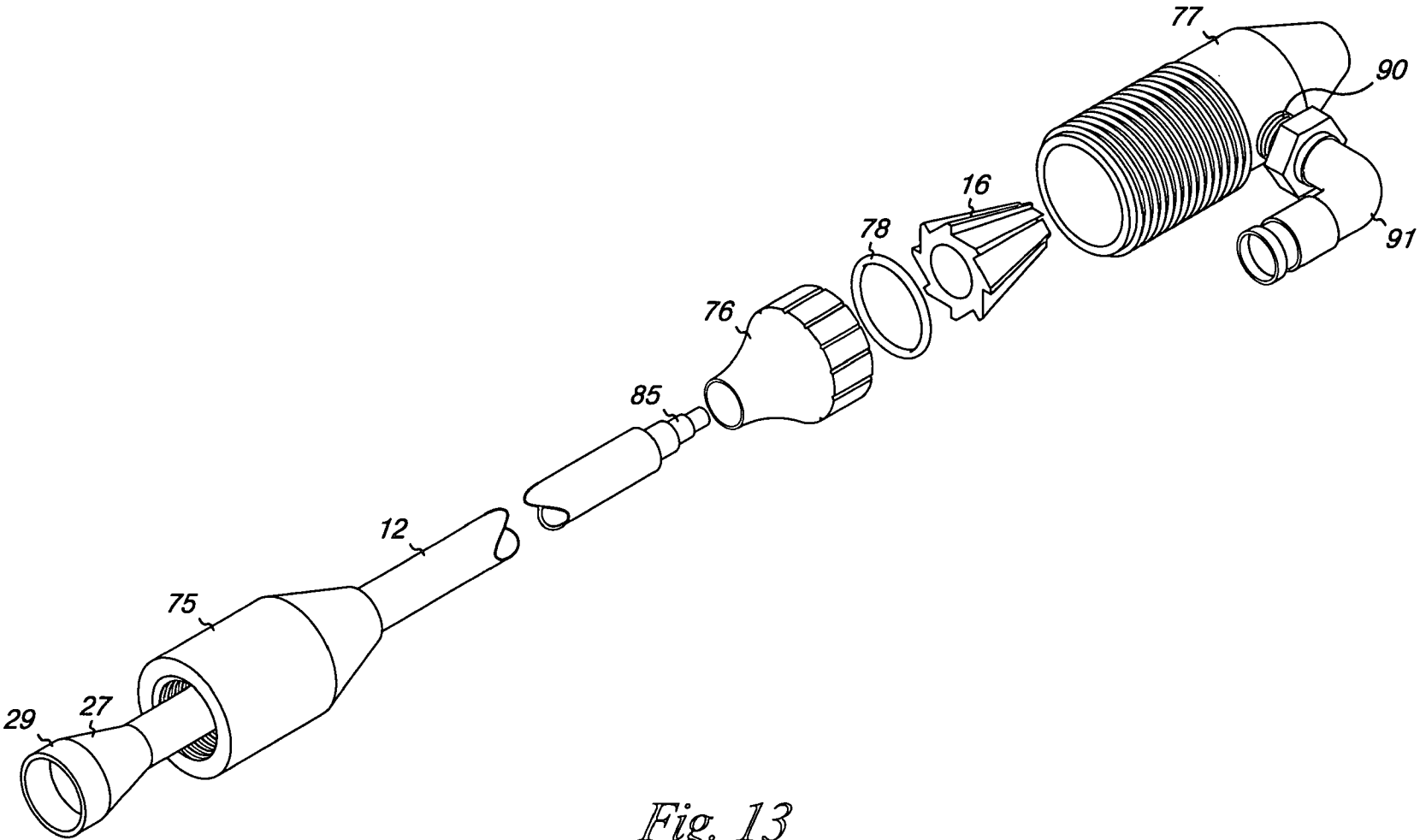
FIG. 13 is an isometric, fragmentary view of a further embodiment of a fluid application assembly of the present invention.
Figure 14:
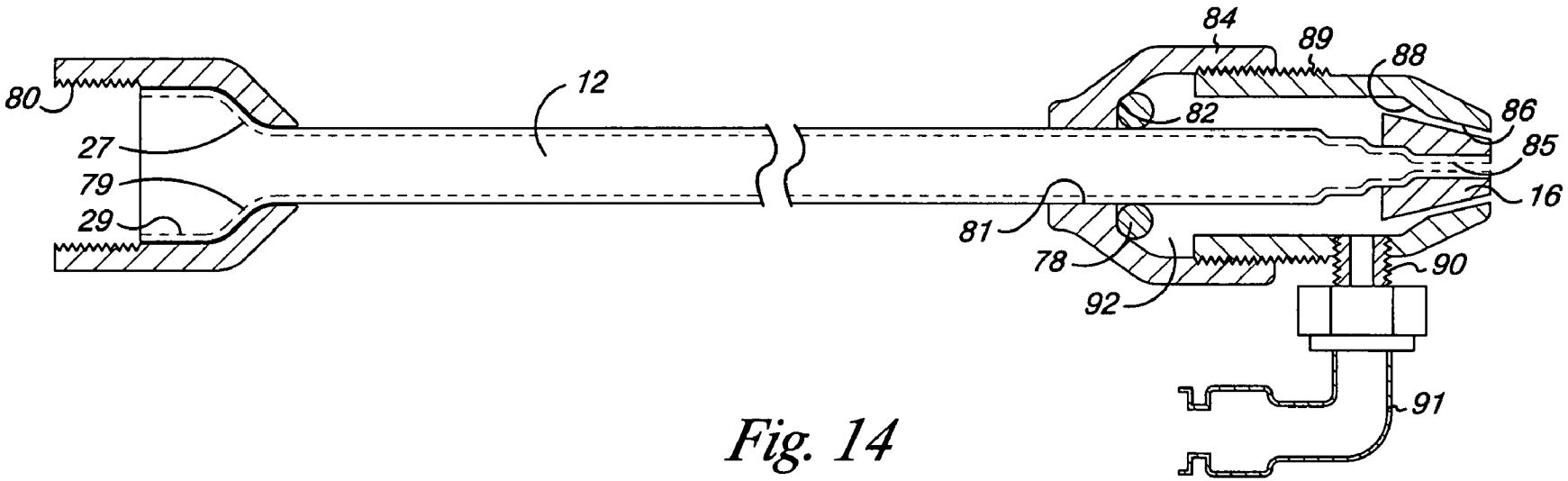
FIG. 14 is a view, partially in section, of the fluid application assembly of FIG. 13.

A further embodiment of a spray head and mixer assembly is shown in FIGS. 13 and 14. In this embodiment, the mixer body 11 of FIG. 1 is replaced by the pair of nuts 75 and 76 and the rubber O-ring retaining grommet 78. As shown, the mixer tube 12 includes a rearward end similar to that of FIG. 1 with a beveled seat portion 27 and rearward annular portion 29. The rear nut 75 is a connection nut which is slipped onto the tube 12 at its forward end and includes an inner beveled surface 79 to seat against the beveled seat portion 27. The nut 75 includes internal threads 80 for connection to a supply of pressurized application fluid (not shown).

The nut 76 is a retaining nut which includes a rearward cylindrical portion 81 having a diametrical dimension approximating or slightly larger than the exterior diameter of the tube 12. Immediately forward of the portion 81 is an interior surface designed to seat against a retaining member in the form of the O-ring grommet 78. The forward end of the nut 76 includes internal threads for connection to the air cap assembly 77.

The O-ring grommet 78 is slipped onto the mixing tube 12 after the nuts 75 and 76 have been slipped on and preferably has an internal diameter slightly smaller than that of the tube 12. When applied to the tube 12, the grommet 78 has sufficient stiffness and there is sufficient friction between the grommet 78 and the tube 12 to retain the nut 76 when tightened against the air cap assembly 77. If needed or desired, a second O-ring grommet or other retaining member can be provided. The grommet 78 or other retaining member must be selectively removable from the tube 12 and must be sufficient to retain the nut for the purpose intended.

The embodiment of FIGS. 13 and 14 is provided with an air manifold or mixer tip 16 at the forward end 85 of the tube 12. The tip 16 is the same as the tip 16 shown and described with respect to the embodiment of FIG. 1 and is sized to fit over the end 85 so that the forwardmost end surface of the end 85 is substantially flush with the forwardmost end surface of the tip 16.

The air cap assembly 77 includes inner conical surfaces 86 and 88 similar to the conical surfaces 56 and 58 of FIG. 7. Like the surfaces 56 and 58 of FIG. 7, the surfaces 86 and 88 cooperate with the outer surface of the mixer tip 16 to provide a plurality of atomizing air flow passages. The rearward end of the assembly 77 includes external threads 89 for connection to the retaining nut 76 as shown. An externally threaded top 90 is threadedly received by a port in the body of the assembly 77 to connect an air supply fitting 91. The fitting 91 is designed for connection to a supply of atomizing air (not shown).

When connected with the mixer tube 12, the nut 76 and the assembly 77 define an atomizing air chamber 92 to provide atomizing air to the passages between the tip 16 and the conical surfaces 86 and 88. This embodiment provides a spray head construction in which the body 11 can be eliminated and in which the atomizing assembly comprised of the nut 76, the assembly 77 and the tip 16 can be easily changed for cleaning or for replacement or the like. Further, all of the air atomizing components of the embodiment of FIGS. 13 and 14 can be constructed of plastic and injection molded. The components can also be made of other materials such as light weight metals.

Although the description of the preferred embodiment has been quite specific, it is contemplated that various modifications could be made without deviating from the spirit of the present invention. Accordingly, it is intended that the scope of the present application be dictated by the appended claims rather than by the description of the preferred embodiment.

What is claimed is:

1. A spray device for delivering an application fluid to a substrate comprising:

a centrally located application fluid orifice;

an atomizing assembly surrounding said orifice and including:

an inner element having a central axis and an outer frustoconical surface portion, said outer frustoconical surface portion converging toward said forward end and forming a frustoconical angle with said central axis of less than 45 degrees;

an outer element with an inner frustoconical surface portion, said inner frustoconical surface portion converging toward said forward end, said inner and outer frustoconical surface portions being in substantial engagement with each other, and a plurality of flow passages between said outer frustoconical surface and said inner frustoconical surface portion, each of said flow passages extending in a spiral pattern along said one frustoconical surface toward the forward end of said one frustoconical surface portion, each of said flow passages having a cross-sectional configuration at the forward end of said one frustoconical surface portion in which the circumferential dimension of said flow passage is at least twice the radial dimension of said flow passage.

2. The spray device of claim 1 wherein said plurality of flow passages are formed by grooves in said outer frustoconical surface portion.

3. The spray device of claim 1 wherein said frustoconical angle is at least about 10 degrees.

4. The spray device of claim 3 wherein said frustoconical angle is about 15 to 25 degrees.

5. The spray device of claim 1 wherein said circumferential dimension is at least three times said radial dimension.

6. The spray device of claim 1 including an atomizing fluid body defining an atomizing fluid chamber in communication with said fluid flow passages.

7. The spray device of claim 6 including an inlet port in communication with said atomizing fluid chamber for providing pressurized atomizing fluid to said chamber.

8. The spray device of claim 1 wherein said inner element includes a forward end and a rearward end and wherein said plurality of grooves extend from the rearward end of said inner element to the forward end of said inner element.

9. The spray device of claim 2 wherein said frustoconical angle is at least about 10 degrees.

10. The spray device of claim 9 wherein said frustoconical angle is about 15 to 25 degrees.

11. An atomizing assembly for a spray gun comprising:

a first member having an outer frustoconical surface with a forward end;

a second member having an inner frustoconical surface with a forward end, said first member and said second member being positionable relative to one another so that said outer frustoconical surface and said inner frustoconical surface are in substantial engagement; and a plurality of spiral flow paths between said inner and outer frustoconical surfaces extending to the forward end of said one frustoconical surface, each of said flow paths having a cross-sectional configuration at the forward end of said one frustoconical surface with a radial dimension and a circumferential dimension in which said circumferential dimension is at least twice said radial dimension and wherein said one frustoconical surface includes a axis of revolution and forms a frustoconical angle with said axis and wherein said frustoconical angle is less than 45 degrees.

12. The atomizing assembly of claim 11 wherein said plurality of flow paths are formed by grooves in said outer frustoconical surface.

13. The atomizing assembly of claim 11 wherein said frustoconical angle is at least about 10 degrees.

14. The atomizing assembly of claim 13 wherein said frustoconical angle is about 15 to 25 degrees.

15. An air atomized application device for applying an application fluid to a substrate comprising:

an elongated application fluid supply tube having a rearward end for connection to a source of pressurized application fluid and having a forward nozzle end with a nozzle opening;

an atomizing fluid body at the forward end of said supply tube, said atomizing fluid body having an inlet port for connection with a source of pressurized atomizing fluid and a chamber in communication with said inlet port; and an atomizing member including an axis of revolution and a central opening for receiving said nozzle end and a plurality of spiral flow paths in communication with said chamber and extending in a converging, spiral pattern toward its forward end wherein said flow paths converge toward said forward end at an angle less than 45 degrees relative to said axis of revolution, each of said flow paths having a circumferential dimension and a radial dimension in which said circumferential dimension is at least twice said radial dimension.

16. The application device of claim 15 wherein said atomizing member includes an outer frustoconical surface and said atomizing fluid body includes a mating inner frustoconical surface.

17. The application device of claim 16 wherein said spiral pathways are defined by a plurality of grooves in one of said inner and outer frustoconical surfaces.

18. The applicator device of claim 17 wherein said grooves are formed in said outer frustoconical surface.

19. An air atomized application device for application of an application fluid to a substrate comprising:

an application fluid supply tube having a rearward end for connection to a source of pressurized application fluid, a tubular body and a forward end having a nozzle opening;

a retaining nut slidable along said tubular body;

a selectively removable retaining member positioned on said tubular body between said retaining nut and said forward end;

an atomizing fluid tip at said forward end, said atomizing fluid tip having an outer conical surface with a central axis and a forward end;

an end cap having an inner conical surface mating with said outer conical surface and being connectable to said retaining nut to define an atomizing fluid chamber, said end cap further including a port for connection to a supply of pressurized atomizing fluid; and one of said inner and outer conical surfaces including a plurality of grooves to define a plurality of atomizing fluid passages, said fluid passages converging toward the forward end of said fluid tip at an angle less than 45 degrees relative to said central axis.

20. The device of claim 19 wherein said outer conical surface includes a plurality of grooves.

* * * * *